US007172093B2

(12) United States Patent
Bando

(10) Patent No.: US 7,172,093 B2
(45) Date of Patent: Feb. 6, 2007

(54) CONTAINER FOR DISPENSATION OF WET TISSUES

(75) Inventor: Takeshi Bando, Kagawa-ken (JP)

(73) Assignee: Uni-Charm Corporation, Ehime-ken (JP)

( * ) Notice: Subject to any disclaimer, the term of this patent is extended or adjusted under 35 U.S.C. 154(b) by 0 days.

(21) Appl. No.: 11/229,545

(22) Filed: Sep. 20, 2005

(65) Prior Publication Data

US 2006/0060598 A1 Mar. 23, 2006

(30) Foreign Application Priority Data

Sep. 22, 2004 (JP) ..... 2004-275173
Sep. 7, 2005 (JP) ..... 2005-259914

(51) Int. Cl.
*B65H 1/10* (2006.01)
*A47K 10/24* (2006.01)
*B65D 73/00* (2006.01)
*B65D 51/18* (2006.01)

(52) U.S. Cl. ..... 221/63; 221/46; 206/494; 220/254

(58) Field of Classification Search ..... 221/63, 221/46, 33, 45, 48; 206/494, 37, 233, 812
See application file for complete search history.

(56) References Cited

U.S. PATENT DOCUMENTS 2,640,587 A * 6/1953 Smith ..... 206/37
4,185,754 A 1/1980 Julius
4,244,493 A * 1/1981 Harrison ..... 221/46
5,516,001 A * 5/1996 Muckenfuhs et al. ..... 221/63
5,938,069 A 8/1999 Macchia
6,206,221 B1 * 3/2001 Bando et al. ..... 220/254.5
6,409,044 B1 * 6/2002 Brown et al. ..... 221/63
6,419,114 B1 * 7/2002 Lenz et al. ..... 221/47
6,554,156 B1 * 4/2003 Chong ..... 221/63
6,655,544 B1 * 12/2003 Tanaka et al. ..... 220/835
6,766,919 B2 * 7/2004 Huang et al. ..... 221/63
6,817,484 B2 * 11/2004 Morin et al. ..... 221/48
6,905,025 B2 * 6/2005 Morin ..... 206/494
2002/0017522 A1 * 2/2002 Bando et al. ..... 220/254
2003/0155263 A1 * 8/2003 Morin ..... 206/494
2003/0155264 A1 * 8/2003 Morin ..... 206/494
2005/0205594 A1 * 9/2005 Evans et al. ..... 221/63
2005/0258062 A1 * 11/2005 Bando ..... 206/494

FOREIGN PATENT DOCUMENTS

DE 101 39 852 2/2003
EP 0 006 709 1/1980
JP 1996-72949 3/1996

* cited by examiner

*Primary Examiner*—Kathy Matecki
*Assistant Examiner*—Rakesh Kumar
(74) *Attorney, Agent, or Firm*—Lowe Hauptman & Berner LLP

(57) ABSTRACT

A container for dispensation of wet tissues includes an elastically flexible flap causing a part of the uppermost wet tissue exposed outward from the container through an opening to collapse toward a hinge of a lid. The flap has a covering portion adapted to cover the opening and a distal portion on the opening's periphery extending beyond the opening. The container ensures that the part of the wet tissue is held between the opening's periphery and the distal portion of the flap.

4 Claims, 7 Drawing Sheets

CONTAINER FOR DISPENSATION OF WET TISSUES

RELATED APPLICATIONS

The present application is based on, and claims priority from, Japanese Application Serial No. 2004-275173, filed Sep. 22, 2004 & Japanese Application Serial No. 2005-259914, filed Sep. 7, 2005, the disclosures of which are hereby incorporated by reference herein in their entireties.

BACKGROUND OF THE INVENTION

This invention relates to a container for dispensation of wet tissues packing a plurality of wet tissues stacked one upon another so as to be pulled out from the container one by one.

There have already been proposed refillable containers for a tissue package containing therein a plurality of wet tissues stacked one upon another. One of the containers is disclosed in Japanese Unexamined Patent Application Publication No. 1996-72949 (REFERENCE), which has a top wall formed with an opening allowing the wet tissues to be pulled out from the container one by one and a lid allowing the top wall inclusive of the opening to be opened and to shut. The top wall has its peripheral edge detachably fitted into respective top edges of side edges. The lid is swingable in a back and forth direction of the container on a hinge formed integrally with the peripheral edge of the top wall. The lid may be disengaged from the side walls to remove the top wall and thereby the container may be refilled with a new tissue package. After the container has been refilled with the new tissue package, the top wall may be fitted again in the respective upper edges of the side walls.

Within the tissue package, the wet tissues are stacked so that each of the wet tissues is folded in two and one half of this wet tissue is interleaved between respective halves of the wet tissue immediately underlying the aforementioned wet tissue and folded in two and so on. To pull the uppermost wet tissue out from the container, the lid is opened, a part of this tissue exposed through the opening is held between the user's fingers and this wet tissue is pulled upward against a frictional resistance generated between the edge of the opening's periphery surrounding the opening and the wet tissue being in contact with this edge. The wet tissue having been completely pulled out from the container pulls the wet tissue immediately underlying the aforementioned wet tissue and partially exposed through the opening. In this way, the wet tissues can be pulled out from the container one by one. After each of the wet tissues has been pulled out from the container, it is important to shut the lid down and thereby to close the opening in order to prevent the remaining wet tissues within the container from being dried.

In the case of the container disclosed in REFERENCE, the part of the wet tissue exposed outward through the opening may protrude outward beyond the peripheral edge of the lid if the part of the wet tissue exposed outward through the opening collapses toward the side opposite to the hinge of the lid. If the part of the wet tissue protrudes outward beyond the peripheral edge of the lid, this part of the wet tissue will prevent the lid from being shut down. As a result, the lid can not be properly shut down or the lid will be shut down with the part of the wet tissue interposed between the top wall and the periphery of the lid.

SUMMARY OF THE INVENTION

In view of the problem as has been described above, it is an object of this invention to provide a container for dispensation of wet tissues improved so that the part of the wet tissue reliably collapses toward the hinge for the lid lest the wet tissue should prevent the lid from being reliably shut down.

According to this invention, there is provided a container for dispensation of wet tissues comprising a container body having a top wall formed with an opening allowing wet tissues to be pulled out from the container body one by one and a lid being swingable in a back and forth direction of the container body on a hinge with which the lid is contiguous to the top wall so that the opening and a periphery of the opening surrounding the opening are covered.

The container body further comprises an elastically flexible flap lying between the top wall and the lid. The flap has a proximal portion on an opposite side of the hinge. The flap extends onto the opening from the proximal portion toward the hinge so as to be elastically bendable upward by a press-up of the wet tissue which exerts against the flap as the wet tissue is pulled out from the container body. The flap is capable of collapsing a part of the wet tissue exposed outward through the opening toward the hinge under an elasticity of the flap.

This invention may include preferred embodiments as follows:

The flap has a covering portion lying above the opening and a distal portion being contiguous to the covering portion and extending beyond the opening so that the distal portion lies on a periphery of the opening in a vicinity of the hinge.

The opening has a first concave space curved toward the hinge.

The covering portion including the distal portion of the flap is divided into first and second portions, and a second concave space is defined between the first and second portion so as to curve toward the proximal portion, and a central opening is defined between the first and second concave spaces.

The container body including the top wall comprises a reinforcing flame having a rigidity higher than that of the container body including the top wall and surrounding the opening. The reinforcing frame is integrated with the top wall. The lid has a rigidity higher than that of the container body including the top wall and is contiguous to the reinforcing frame with the hinge.

The container according to this invention is advantageous in aspects as follows: The elastically flexible flap causes a part of the wet tissue exposed through the opening to collapse toward the hinge of the lid and therefore the part of the wet tissue will not collapse toward the side opposite to the hinge. In addition, even if the wet tissue is exposed outward over a relatively large extent through the opening, the part of the wet tissue will not reliably collapses toward the hinge and there is no anxiety that the part of the wet tissue might protrude outward beyond a peripheral edge of the lid. The container is free from an apprehension that the part of the wet tissue exposed through the opening might prevent the lid from being reliably shut down. There is no possibility also that the lid might be shut down with the part of the wet tissue wedged between the top wall and the periphery of the lid.

An embodiment of this invention wherein the distal portion of the flap lies on the opening's periphery extending in the vicinity of the hinge of the lid is advantageous in aspects as follows: The part of the wet tissue exposed outward through the opening is reliably held between the opening's periphery and the distal portion of the flap so as to collapse toward the hinge of the lid without any anxiety that the part of the wet tissue might collapse toward the side opposite to the hinge. In addition, the part of the wet tissue exposed outward through the opening is held between the opening's periphery and the distal portion of the flap.

An embodiment of this invention wherein the opening has the first concave space, the cover portion of the flap has the second concave space and the central opening is defined between the first and second concave spaces is advantageous in aspects as follows: Such features facilitate the user to insert the fingers through the first concave space or the central opening into the container body and to hold an uppermost one of the wet tissue packed within the container body.

An embodiment of this invention wherein the container body including the top wall comprises the reinforcing frame having a rigidity higher than that of the container body including the top wall, the reinforcing frame is integrated with the top wall and the lid has a rigidity higher than that of the container body including the top wall is advantageous in aspects as follows: Even if the container body is formed from flexible materials, there will be provided a container having a stable configuration by the reinforcing frame and the lid and reliable in opening and closing operation of the lid.

DETAILED DESCRIPTION OF THE PREFERRED EMBODIMENTS

Details of a container for dispensation of wet tissues according to this invention will be more fully understood from the description given hereunder with reference to the accompanying drawings.

Figure 1:
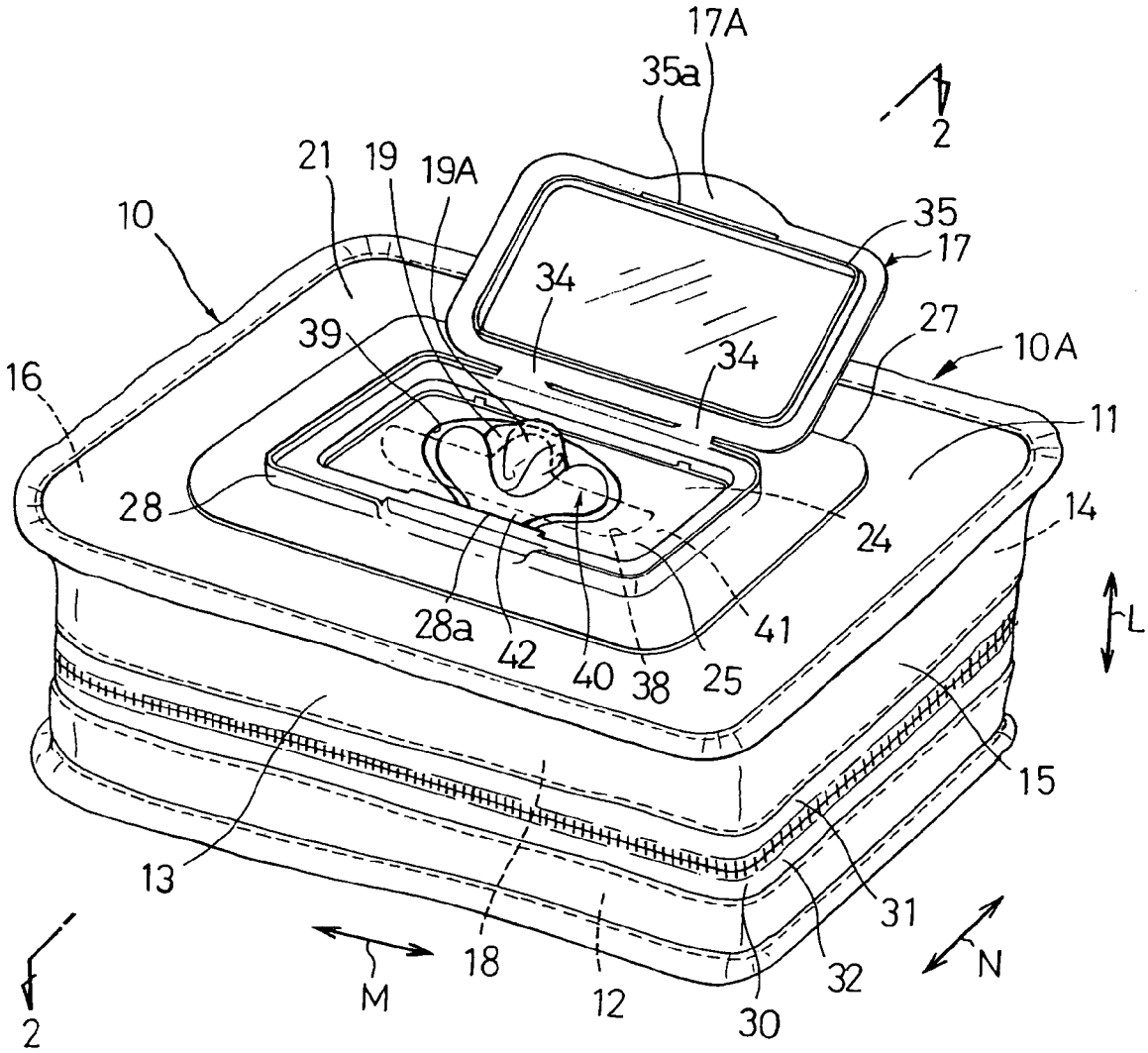
FIG. 1 is a perspective view showing a container for dispensation of wet tissues as a first embodiment of this invention.
Figure 2:
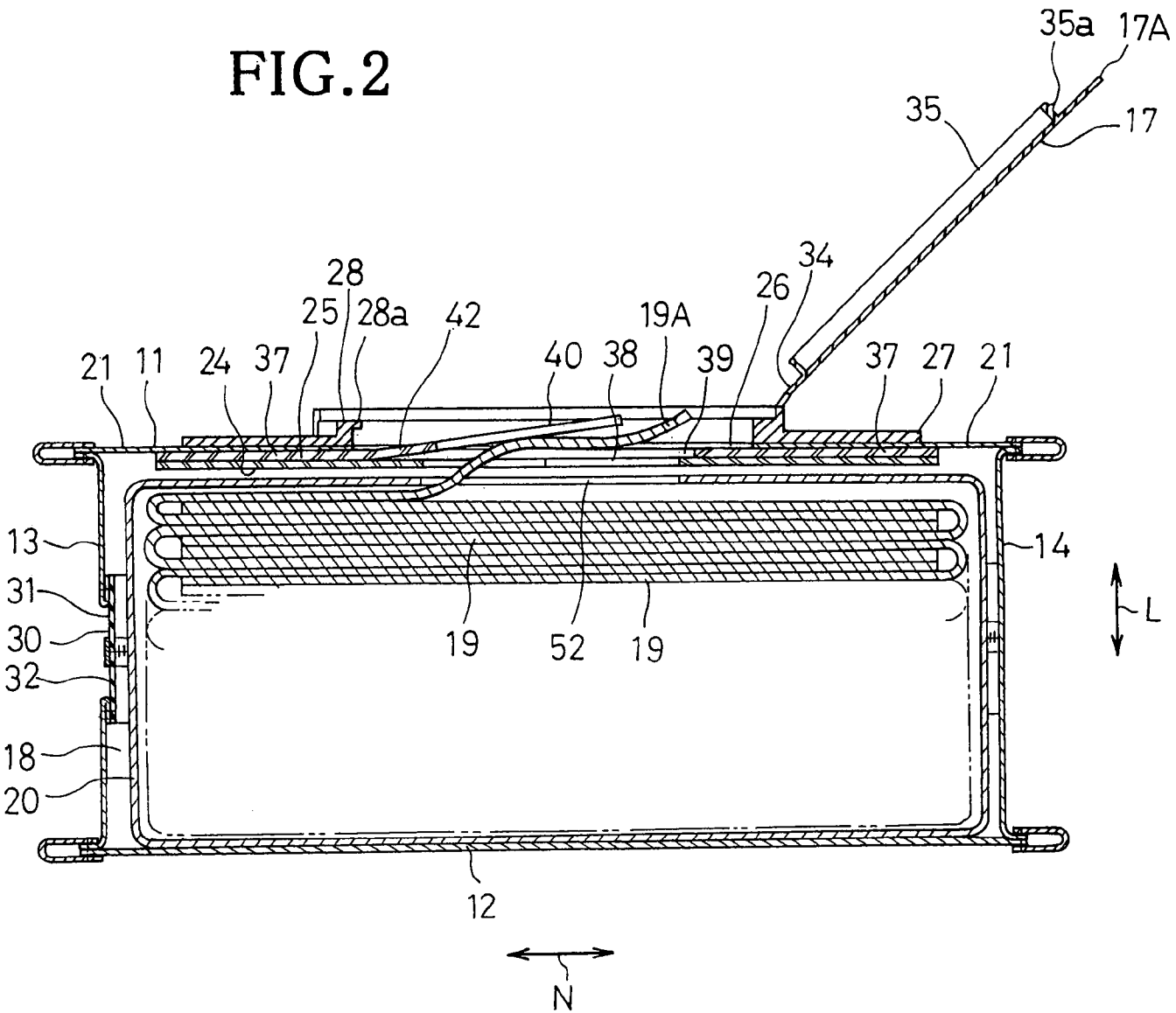
FIG. 2 is a sectional view taken along the line 2—2 in FIG. 1.
Figure 3:
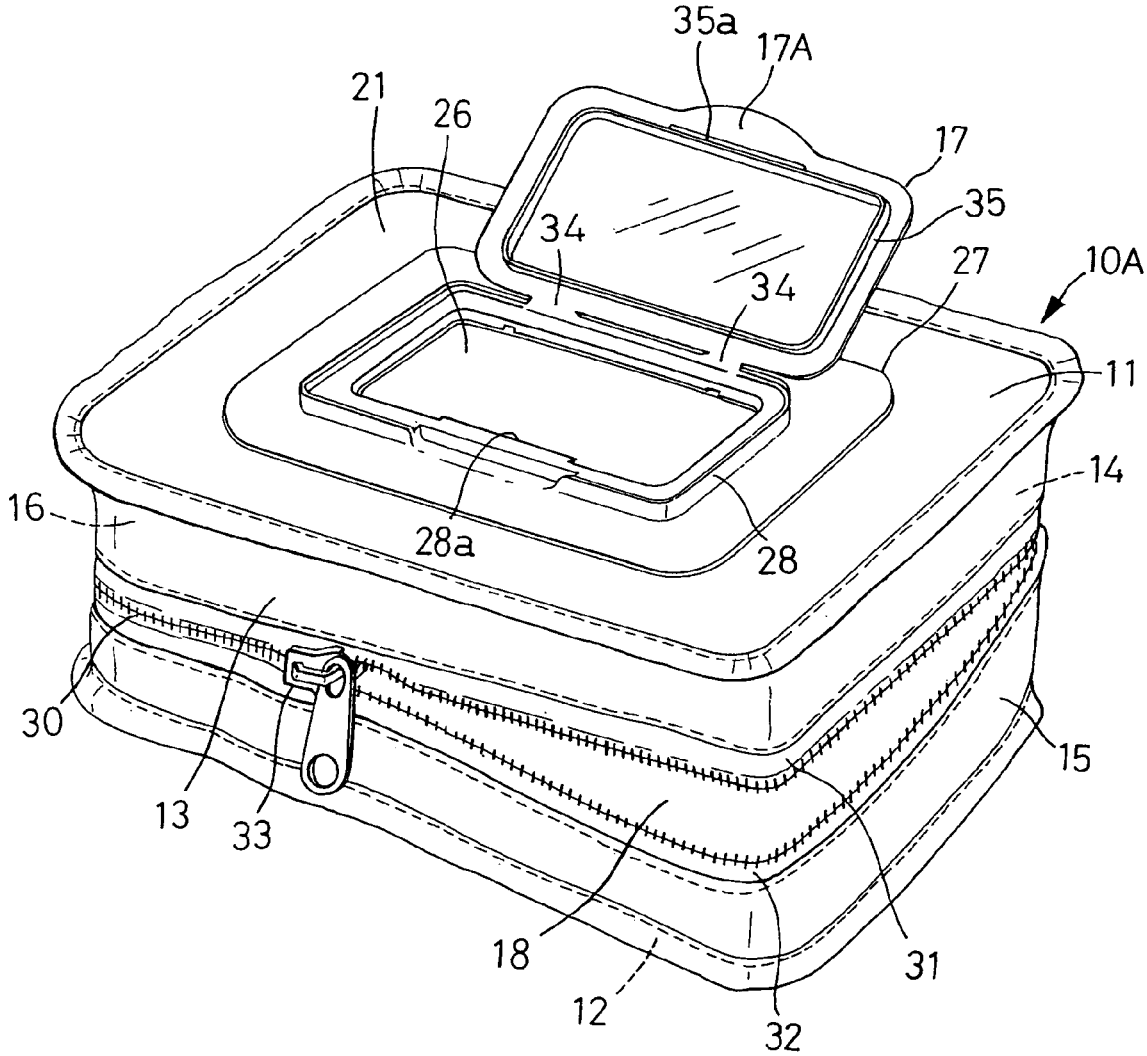
FIG. 3 is a perspective view showing the container with a plate assembly as well as packed tissues removed from the container.
Figure 4:
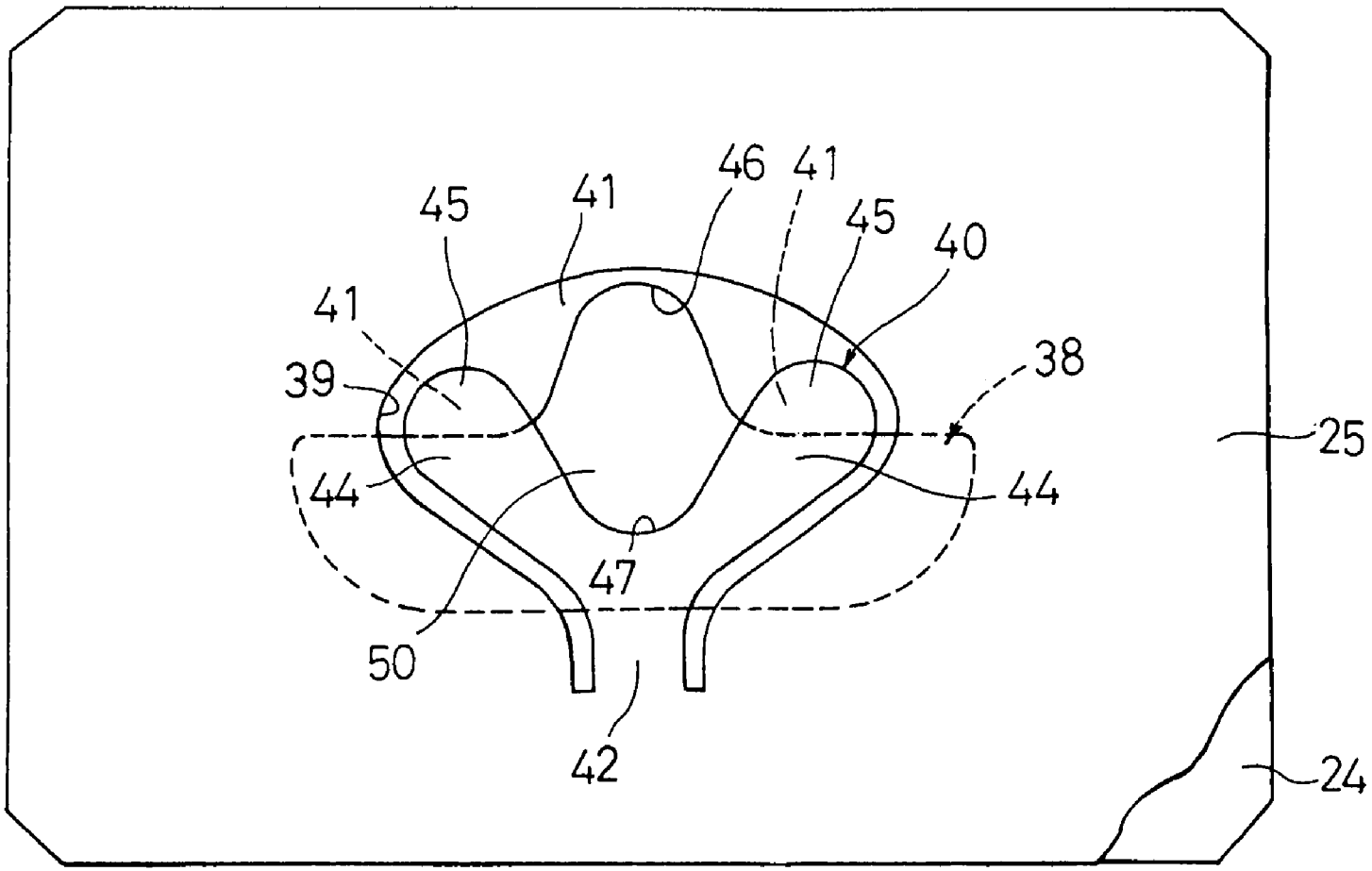
FIG. 4 is a plan view showing the plate assembly dismounted from the container.

FIG. 1 is a perspective view showing a container 10 for dispensation of wet tissues with a lid 17 opened, FIG. 2 is a sectional view taken along the line 2—2 in FIG. 1, FIG. 3 is a perspective view showing the container 10 with a plate assembly 24, 25 as well as a package 20 for wet tissues removed from the container 10 and FIG. 4 is a plan view showing the plate assembly 24, 25 dismounted from the container 10. In FIGS. 1 and 2, a vertical direction is indicated by an arrow L, a transverse direction is indicated by an arrow M (in FIG. 1 alone) and a back-and-forth direction is indicated by an arrow N. In FIGS. 1 and 2, apart 19A of an individual wet tissue 19 is exposed outward from the container 10 through an opening 38.

The container 10 includes a container body 10A and the lid 17. The container body 10A is formed by rectangular top and bottom walls 11, 12 opposed to each other in the vertical direction, rectangular front and rear side walls 13, 14 extending in the vertical direction so as to be opposed to each other in the back-and-forth direction, rectangular right and left side walls 15, 16 extending in the vertical direction so as to be opposed to each other in the transverse direction. The lid 17 is mounted on the top wall 11. The container body 10A has a hexahedron including these flexible walls 11, 12, 13, 14, 15, 16 which are substantially orthogonal one to another. These walls 11, 12, 13, 14, 15, 16 of the container body 10A defines inside thereof a packing space 18 for a package 20 containing a plurality of wet tissues 19.

The top wall 11 consists of a peripheral region 21 formed from a flexible plastic sheet and first and second plates 24, 25 underlie the top wall 11. The top wall 11 is centrally formed with a rectangular through-hole 26 and parts of the plate assembly 24, 25 extend in the through-hole 26. The top wall 11 further includes a reinforcing frame 27 surrounding the through-hole 26. The reinforcing frame 27 is made of a plastic material having a rigidity higher than that of the container body including the top wall 11 and fixed to the upper surface of the top wall 11. The lid 17 has a protuberant edge 35 formed on an inner surface of the lid 17, a protuberance 35*a* formed in a front side middle portion of the protuberant edge 35 and a pick-up tab 17A formed at a distal portion of the lid 17. The reinforcing frame 27 is formed on its inner peripheral edge 28 with a protuberance 28*a* engaged with the protuberance 35*a* when the lid 17 has been shut. The bottom wall 12 is made of a flexible plastic sheet. The front and rear side walls 13, 14 as well as the right and left side walls 15, 16 are made of a nonwoven fabric 29. The top and bottom walls 11, 12 and the side walls 13, 14, 15, 16 are connected one with another by stitching these walls together.

A zipper 30 extends in a circumferential direction of the container body 10A across the front and rear side walls 13, 14 as well as the right and left side walls 15, 16 at a vertically middle level of these side walls. The zipper 30 includes first and second zipper tapes 31, 32 stitched with these side walls 13, 14, 15, 16 and a slider 33 cooperating with these tapes 31, 32. The slider 33 may be moved in the circumferential direction of the container body 10A to engage these tapes 31, 32 with each other or to disengage these tapes 31, 32 from each other.

The lid 17 is made of a plastic material having a flexural rigidity higher than that of the top wall 11 in the form of a rectangle which is relatively long in the transverse direction. The lid 17 is swingable on a hinge 34 in a back and forth direction of the container body 10A. The hinge 34 is provided integrally with the reinforcing frame 27 and therefore with the top wall 11. The protuberance 35*a* of the lid 17 comes in snap engagement with the protuberance 28*a* of the reinforcing frame 27 from below as the lid 17 is swingable in the forth direction from the position shown in FIG. 1. In this way, the lid 17 is retained at its shut down position. The lid 17 will be swingable upward in the back direction from this shut down position to disengage the protuberances 28*a*, 35*a* from each other and thereby to open the lid 17.

The first and second plates 24, 25 are made of plastic materials having a flexural rigidity higher than that of the top wall 11 and respectively identical to each other in size as well as in shape. Specifically, each of these plates 24, 25 has a rectangular shape. The first plate 24 underlies the second plate 25. These plates 24, 25 are placed one upon another in the vertical direction so as to have respective surfaces opposed and bonded to each other (except a flap 40 as will be described later). The second plate 25 has a peripheral region 37 fixed to the inner surface of the peripheral region 21 of the top wall 11. The first and second plates 24, 25 are centrally formed with openings 38, 39 which the wet tissues 19 can be pulled out one by one from the container body 10A through the opening 38. The opening 38 is elongated in the transverse direction and has a concave space 46 curved toward the hinge 34 in a rear side central portion of the opening 38. The opening 39 is oval-shaped and overlapped with the opening 38.

The container body 10A further comprises an elastically flexible flap 40 capable of collapsing a part 19A of the wet tissue 19 exposed outward through the openings 38, 39 toward the hinge 34. The flap 40 is centrally formed of the second plate 25 and lies between the top wall 11 and the lid 17 and has a proximal portion 42 in a vicinity of a peripheral edge in the front side middle portion of the openings 38, 39. The flap 40 extends horizontally from the proximal portion 42 toward the hinge 34 across the openings 38, 39 and is elastically bendable upward on the proximal portion 42. The flap 40 further has a pair of covering portions 44 extending above the opening 38 so as to cover the opening 38, and distal portions 45 being contiguous to the covering portions 44 and extending beyond the opening 38. The proximal portion 42 is located on the side opposite to the hinge 34 about the opening 38. Upward flexural rigidity exhibited by the flap 40 is maximum at the distal portion 45 and minimum at the proximal portion 42. The flap 40 is formed with a concave space 47 curved toward the proximal portion 42 between the covering portions 44, the concave space 47 is defined a central opening 50 cooperatively with the concave space 46 of the openings 38, 39.

The individual wet tissues 19 have a rectangular planar shape and a plurality of such wet tissues 19 are stacked in the vertical direction within the package 20. Within the package 20, the individual wet tissues 19 are respectively folded in two so that one of the individual wet tissues 19 folded in this manner has its half interposed between halves of the adjacent folded wet tissue 19. The package 20 is made of a flexible film. A top of the package 20 is formed with a slit 52 through which the individual wet tissues 19 can be drawn out therefrom. Before the package 20 is actually used, a release sheet (not shown) releasably bonded to the top of the package 20 maintains the package 20 closed. Upon peeling the release sheet off from the top, the slit 52 is exposed so that the wet tissues 19 can be drawn out from the package 20 one by one.

Figure 5:
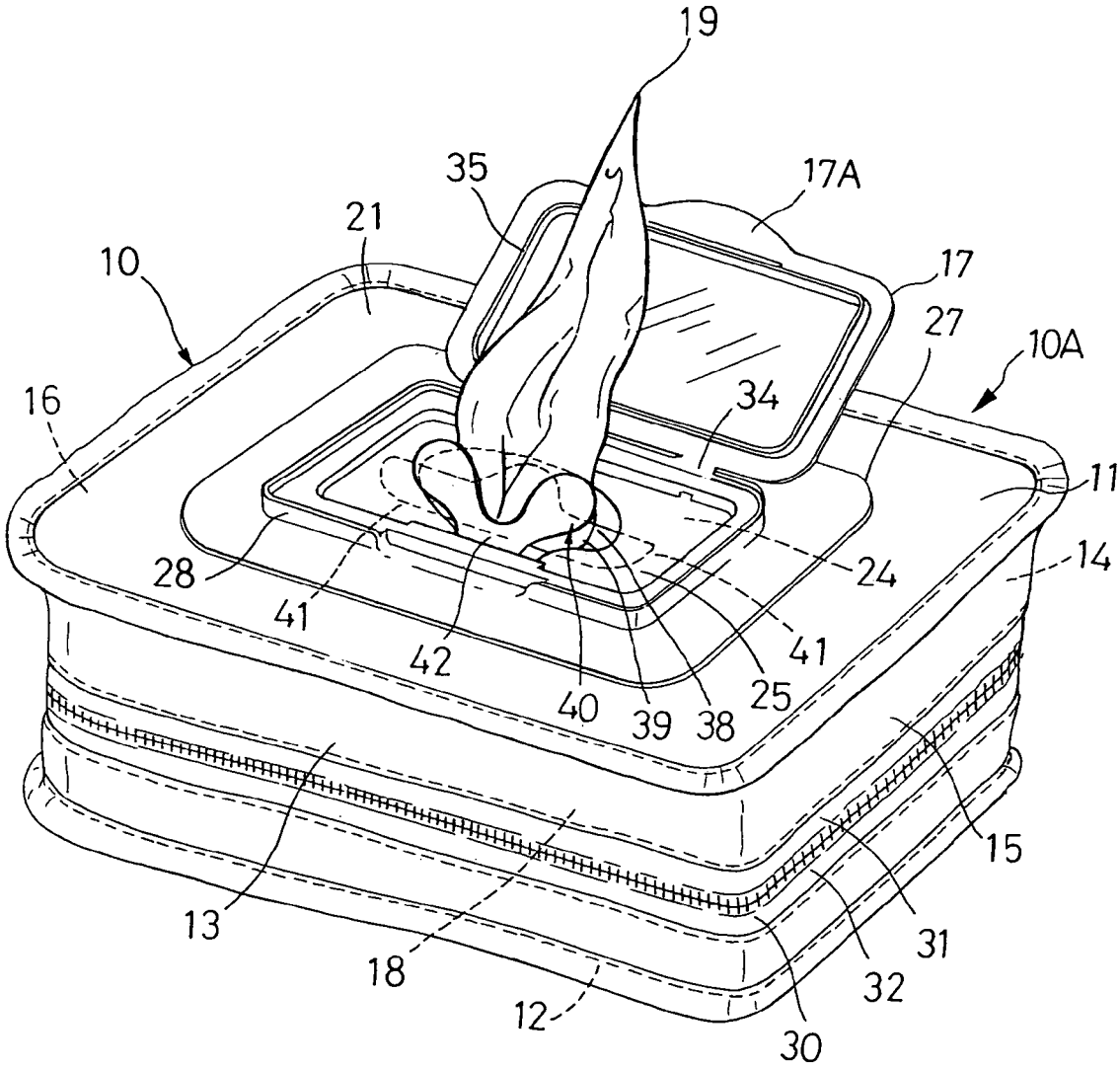
FIG. 5 is a perspective view showing the container as an individual tissue is being pulled out therefrom.

FIG. 5 is a perspective view showing the container 10 as a wet tissue 19 is being pulled out therefrom. The container 10 is used in a sequence as follows: First, the slider 33 is moved so as to disengage the zipper tapes 31, 32 from each other so that the front and rear walls 13, 14 as well as the right and left walls 15, 16 may be respectively divided in two in the vertical direction and thereby the top and bottom walls may be drawn apart from each other in the vertical direction. In this way, the container 10 and therefore the packing space 18 are opened. The package 20 is put into the packing space 18 opened in this manner so that the slit 52 may remain exposed and the slider 33 is moved again to bring the zipper tapes 31, 32 in engagement with each other. Then the lid 17 is opened and the user's fingers are inserted into the packing space 18 through the central opening 50 and one of the individual wet tissues 19 packed in the packing space 18 is held between the fingers. The part 19A of this wet tissue 19 is exposed outward from the container body 10A through the opening 38 and then the lid 17 is shut down.

The flap 40 is elastically bendable on the proximal portion 42 by a press-up of the wet tissue 19 which exerts against the flap 40, as the part 19A of the wet tissue 19 is exposed outward through the opening 38. The flap 40 is restorable under its elasticity toward the hinge 34, i.e., onto the opening 38 as the part 19A of the wet tissue 19 gets free. The part 19A of the wet tissue 19 exposed outward through the opening 38 is held between the opening's periphery 41 and the distal portion 45 of the flap 40 so as to collapse toward the hinge 34.

To pull the individual wet tissues 19 out from the container body 10A one by one, the part 19A of the wet tissue 19 exposed outward through the opening 38 is held by the fingers and pulled upward in the vertical direction against a frictional resistance between the opening's periphery 41 and the wet tissue 19 being in contact with this periphery 41. As shown in FIG. 4, the flap 40 is elastically bendable upward on the proximal portion 42 by a press-up of the part 19A of the wet tissue 19 which exerts against the flap 40 and the wet tissue 19 is more and more exposed outward through the opening 38 as the wet tissue 19 is pulled upward. A wet tissue 19 immediately underlying this wet tissue 19 is partially exposed through the opening 38 as the preceding wet tissue 19 is completely pulled out from the container body 10A. In this manner, the individual wet tissues 19 can be pulled out from the container body 10A one by one. The flap 40 is restorable under its elasticity toward the hinge 34, i.e., onto the opening 38 every time each of the wet tissues 19 has been pulled out from the container body 10A. The part 19A of the wet tissue 19 exposed outward through the opening 38 is held between the opening's periphery 41 and the distal portion 45 of the flap 40 so as to collapse toward the hinge 34. After the wet tissue 19 has been pulled out from the container body 10A in this manner, it is important to shut the lid 17 down and thereby to close the opening 38 as well as the opening's periphery 41 in order to protect the wet tissues 19 remaining within the packing space 18 from being dried. After the wet tissues 19 within the package 20 have been used up, the slider 33 may be moved so as to disengage the zipper tapes 31, 32 from each other to open the packing space 18 and then a new package 20 may be put into the packing space 18.

The container 10 is advantageous in aspects as follows: The flap 40 causes the part 19A of the wet tissues 19 exposed through the opening 38 to collapse toward the hinge 34 of the lid 17 and therefore it is not apprehended that the part 19A might collapse toward the side opposite to the hinge 34 (i.e., toward the proximal portion 42). In addition, it is ensured that the flap 40 causes the part 19A of the wet tissue 19 to collapse toward the hinge 34 because the part 19A of the wet tissue 19 is held between the opening's periphery 41 and the distal portion 45 of the flap 40. Even if the wet tissue 19 is exposed outward over a relatively large extent through the opening 38, there is no anxiety that the part 19A thereof might protrude outward beyond a peripheral edge of the lid 17 because the part 19A of the wet tissue 19 always collapses toward and onto the hinge 34. The container 10 is free from an apprehension that the part 19A of the wet tissue 19 exposed through the opening 38 might prevent the lid 17 from being reliably shut down. There is no possibility also that the lid 17 might be shut down with the part 19A wedged between the frame 27 (i.e., the top wall 11) and the periphery of the lid 17.

The container 10 allows the user to insert the fingers through the central opening 50 into the packing space 18 and to hold the wet tissues 19 packed within the space 18 without any anxiety that the distal portion 45 of the flap 40 might prevent the fingers from reliably holding the uppermost wet tissue 19. In other words, it is ensured that the uppermost wet tissue 19 can be held without bending the flap 40 upward in the vertical direction. In this way, the container 10 allows the uppermost wet tissue 19 to be easily pulled out from the packing space 18. Additionally, even if the uppermost wet tissue 19 retreats into the packing space 18 during use of the container 10, such tissue 19 can be easily pulled out from the container body 10A through the central opening 50.

On the proximal portion 42 of the flap 40, the container 10 exhibits a sufficiently low flexural rigidity to ensure that the flap 40 is easily bendable upward as the wet tissue 19 is pulled out from the container 10. Consequentially, there is no anxiety that the flap 40 might make any significant resistance when it is intended by the user to pull the wet tissue 19 out from the container 10. Thus the wet tissue 19 can be smoothly pulled out from the container 10. Even after the wet tissue 19 packed within the package 20 have been used out, the container 10 is reusable so far as the container 10 is refilled with a new package 20.

Figure 6:
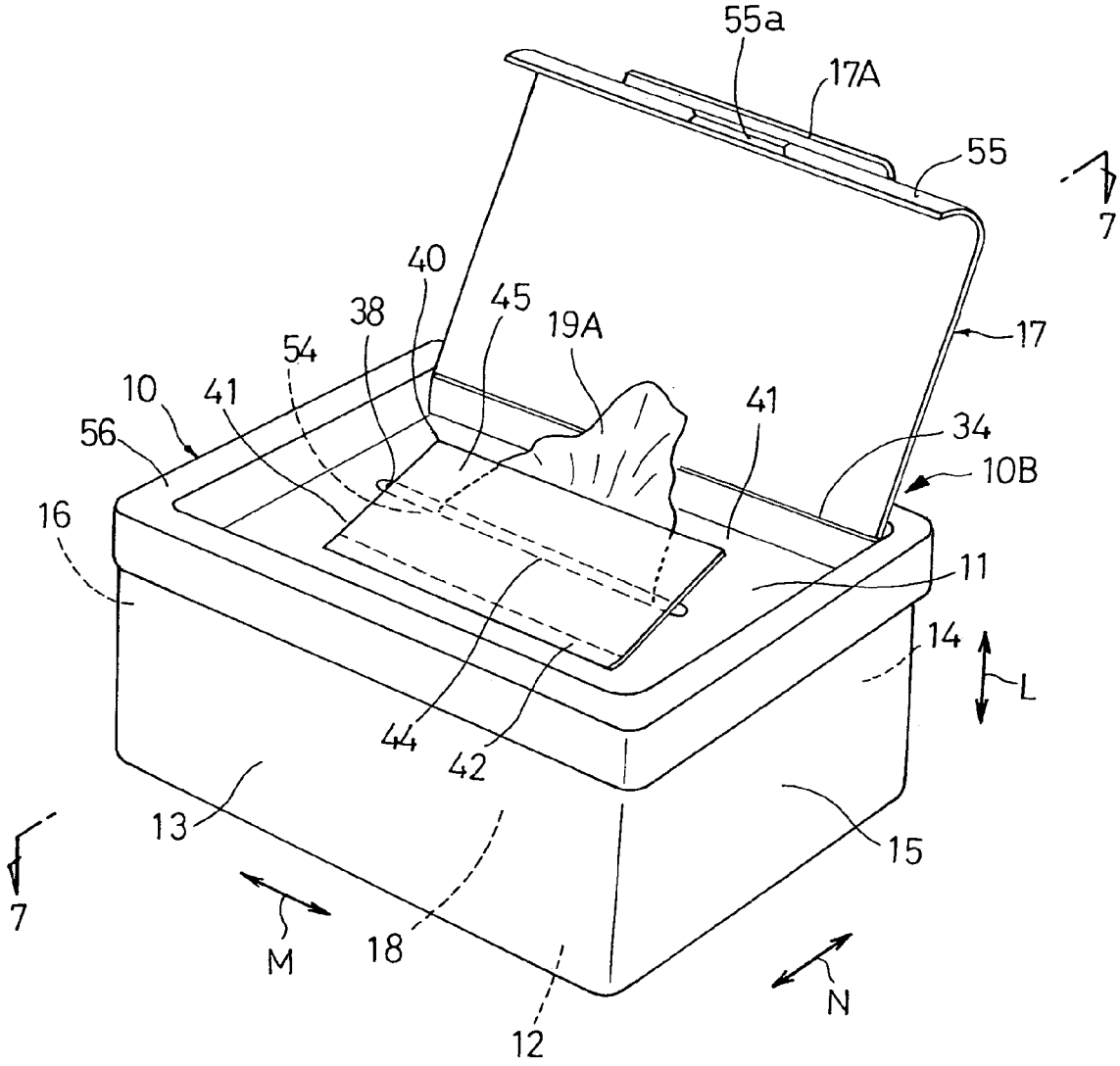
FIG. 6 is a perspective view showing a refillable container for tissues as a second embodiment of this invention.
Figure 7:
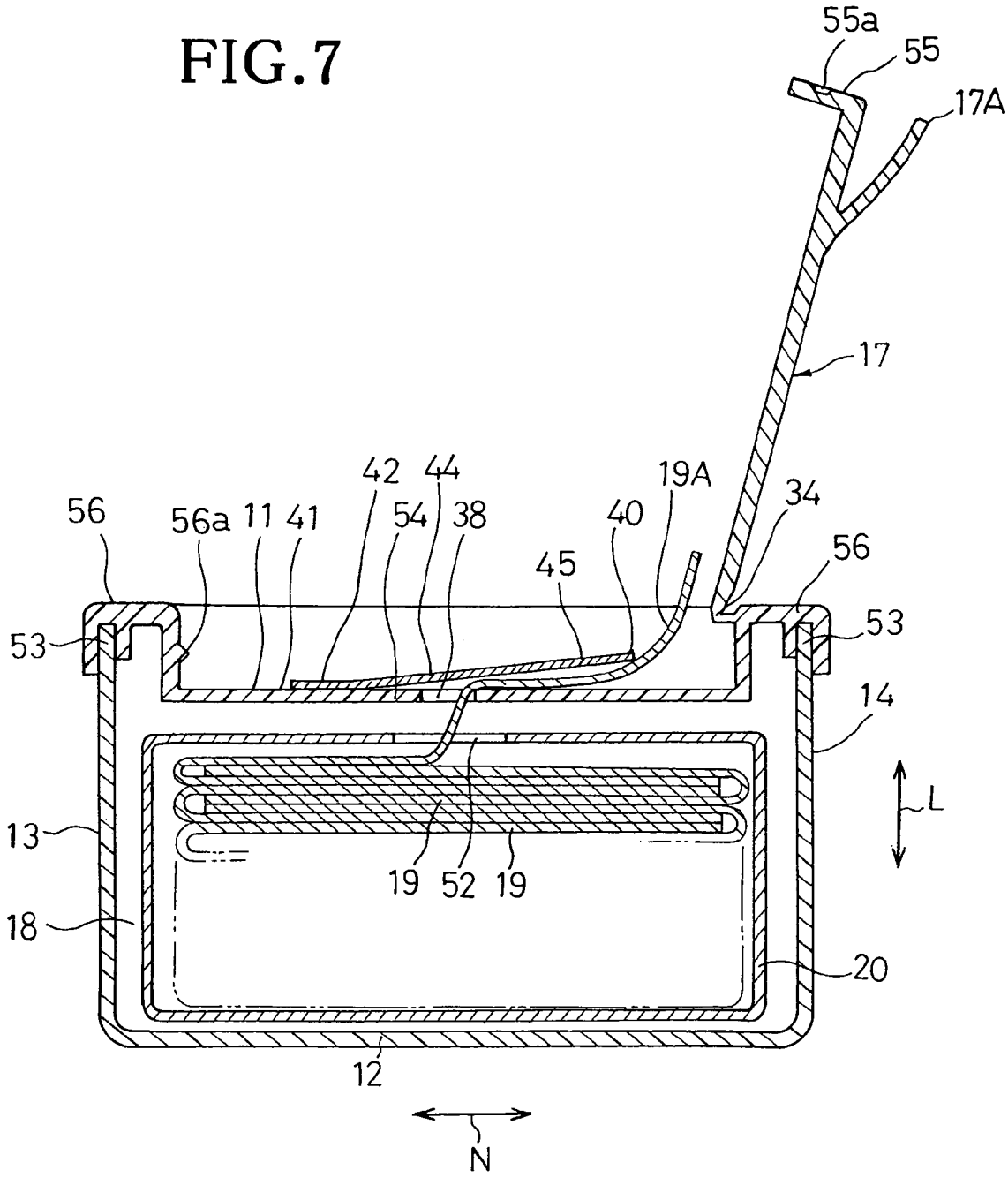
FIG. 7 is a sectional view taken along the line 7—7 in FIG. 6.

FIG. 6 is a perspective view showing a container 10 for dispensation of wet tissues with a rid 17 opened as a second embodiment of this invention and FIG. 7 is a sectional view taken along the line 7—7 in FIG. 6.

The container 10 includes a container body 10B and the rid 17. The container body 10B is formed by rectangular top and bottom walls 11, 12 opposed to each other in the vertical direction, rectangular front and rear side walls 13, 14 extending in the vertical direction so as to be opposed to each other in the back-and-forth direction, rectangular right and left side walls 15, 16 extending in the vertical direction so as to be opposed to each other in the transverse direction. The lid 17 is mounted on the top wall 11. The container body 10B has a hexahedron including these walls 11, 12, 13, 14, 15, 16 which are substantially orthogonal one to another. These walls 11, 12, 13, 14, 15, 16 of the container body 10B defines inside thereof a packing space 18 for a package 20 containing a plurality of wet tissues 19. The container body 10B and the lid 17 are made from relatively rigid plastic materials.

A significant portion of the top wall 11 lies at a level lower than that of respective upper edges 53 of the side walls 13, 14, 15, 16. The top wall 11 has its peripheral edge 56 detachably fitted on the respective upper edges 53 of the side walls 13, 14, 15, 16. The top wall 11 is centrally formed with an opening 38 which is elongated in the transverse direction so that the wet tissues 19 can be pulled out one by one from the container body 10B through this opening 38. The lid 17 has a front side protuberant edge 55 bended inward, a dent 55*a* formed in the front side middle portion of the front side protuberant edge 55 and a pick-up tab 17A formed on the front side upper surface of the lid 17. The top wall 11 is formed on an inner surface of the peripheral edge 56 with a protuberance 56*a* engaged with the dent 55*a* when the lid 17 has been shut. The top wall 11 is provided with an elastically flexible flap 40 causing a part 19A of the uppermost wet tissue 19 exposed outward from the container body 10B through the opening 38 to collapse toward a hinge 34 of the lid 17.

The lid 17 is swingable in a back and forth direction on a hinge 34 formed integrally with the peripheral edge 56 of the top wall 11. The protuberance 56*a* engages with the dent 55*a* as the lid 17 is swingable in the forth direction from the position shown in FIG. 6. In this way, the lid 17 is retained at its shut down position. The lid 17 will be swingable in the back direction from this shut down position to disengage the protuberance 56*a* and the dent 55*a* from each other and thereby to open the lid 17. The lid 17 is able to cover the opening 38 and a periphery 41 of the opening 38.

The flap 40 has a rectangular shape which is relatively long in the transverse direction and lies between the top wall 11 and the lid 17. The flap 40 has a proximal portion 42 fixed to the opening's periphery and extends from the proximal portion 42 toward the hinge 34 so as to cover the opening 38. The flap 40 is elastically bendable upward on the proximal portion 42. The flap 40 has a covering portion 44 lying above the opening 38 and adapted to cover the opening 38 and a distal portion 45 being contiguous to the covering section 44 and extending beyond the opening 38. The distal portion 45 is located above the opening's periphery 41 placed aside toward the hinge 34 so as to cover the opening's periphery 41.

The container 10 is used in a sequence as follows: To set the tissue package 20 in the container body 10B, the top wall 11 is disengaged from the side walls 13, 14, 15, 16 and thereby the top wall 11 is removed from the container body 10B. Then, the package 20 is put into the packing space 18 so that a slit 52 through which the uppermost wet tissue 19 is pulled out from the container body 10B may remain exposed, followed by engaging the top wall 11 with the side walls 13, 14, 15, 16 again. Then the lid 17 is opened and the flap 40 is held by the user's fingers. The flap 40 held by the fingers in this manner is elastically bendable upward to expose the opening 38 and the part 19A of the wet tissue 19 is exposed outward from the container body 10B through the opening 38. Now the lid 17 is shut down. Upon leaving the flap 40 free from the fingers after the part 19A has been exposed, the flap 40 is restorable under its elasticity so as to cover the opening 38. The part 19A of the wet tissue 19 exposed through the opening 38 is held between the opening's periphery 41 and the distal portion 45 of the flap 40 and maintained collapsing toward the hinge 34.

To pull the individual wet tissues 19 out from the container 10 one by one, the lid 17 is opened, the part 19A of the wet tissue 19 exposed outward through the opening 38 is held by the fingers and pulled upward against a frictional resistance between the edge of the opening's periphery 41 and the wet tissue 19 being in contact with this edge of the periphery 41. The flap 40 is elastically bendable upward on the proximal portion 42 by a press-up of the wet tissue 19 and the wet tissue 19 is more and more exposed outward through the opening 38 as the wet tissue 19 is pulled upward. The wet tissue 19 immediately underlying this wet tissue 19 is partially exposed through the opening 38 as the preceding wet tissue 19 is completely pulled out from the container 10. In this manner, the individual wet tissues 19 can be pulled out from the container 10 one by one. The flap 40 is restorable under its elasticity onto the opening 38 every time each of the wet tissues 19 has been pulled out from the container 10. The part 19A of the wet tissue 19 exposed outward through the opening 38 is held between the opening's periphery 41 and the distal portion 45 of the flap 40 so as to collapse toward the hinge 34.

The entire discloses of Japanese Patent Application Nos. 2004-275173 and 2005-259914 filed on Sep. 22, 2004 and Sep. 7, 2005, respectively, including specification, drawings and abstract are herein incorporated by reference its entirety.

What is claimed is:

1. A container for containing and dispensing wet tissues, said container comprising:

a hollow container body having a top wall formed with an opening;

a lid pivotably mounted to said container body via a hinge, said lid having a closed state in which said lid covers completely said opening; and an elastically flexible flap having opposite proximal and distal ends, the proximal end being bonded to a lower surface of said top wall, the distal end of said flap lying between said top wall and said lid when said lid is in the closed state, and the distal end of said flap being closer to said hinge than said proximal end;

wherein said flap extends toward said hinge from below said top wall, obliquely, upwardly, through said opening, to above said top wall;

said container further comprising:

a first plate bonded to the lower surface of said top wall and comprising a first opening and said flap; and a second plate bonded to a lower surface of said first plate and comprising a second opening;

wherein said first and second openings are different in size and shape, and said flap and the second opening define together a central opening for allowing dispensation of the wet tissues.

2. The container according to claim 1, wherein said flap projects from one side of said first opening, into said first opening and towards said hinge; and the distal end of said flap is completely located within said first opening.

3. The container according to claim 2, wherein the proximal end of said flap overlaps a periphery of the second opening on a first side of said second opening, and the distal end of said flap overlaps the periphery of the second opening on an opposite, second side of said second opening.

4. The container according to claim 3, wherein said flap is Y-shaped, and the distal end of said flaps comprise first and second portions which branch from the proximal end and define therebetween a first concave portion curved away from said hinge; and said second opening has a second concave portion curved toward said hinge; and the central opening is defined by said first and second concave portions.

* * * * *